US005137001A

United States Patent [19]

Taniguchi

[11] Patent Number: 5,137,001

[45] Date of Patent: Aug. 11, 1992

[54] CONTROL APPARATUS FOR AN ENGINE

[75] Inventor: Nobutake Taniguchi, Himeji, Japan

[73] Assignee: Mitsubishi Denki K.K., Tokyo, Japan

[21] Appl. No.: 653,911

[22] Filed: Feb. 12, 1991

[30] Foreign Application Priority Data

Feb. 23, 1990 [JP] Japan ..... 2-43624

[51] Int. Cl.[5] ..... F02M 51/00

[52] U.S. Cl. ..... 123/494; 123/492

[58] Field of Search ..... 123/494, 492; 73/118.2

[56] References Cited

U.S. PATENT DOCUMENTS

| | | | |
|---|---|---|---|
| 4,706,681 | 11/1987 | Wataya | 123/494 |
| 4,719,890 | 1/1988 | Watava et al. . | |
| 4,807,581 | 2/1989 | Nishikawa | 123/492 |
| 4,905,155 | 2/1990 | Kanno | 123/494 |
| 4,951,209 | 8/1990 | Nagaishi | 123/492 |
| 4,957,088 | 9/1990 | Hosaka | 123/492 |
| 4,967,715 | 11/1990 | Hosaka | 123/494 |
| 4,976,243 | 12/1990 | Sano | 123/492 |

FOREIGN PATENT DOCUMENTS

| | | | |
|---|---|---|---|
| 0202359 | 11/1983 | Japan | 123/494 |

*Primary Examiner*—Carl S. Miller

*Attorney, Agent, or Firm*—Sughrue, Mion, Zinn Macpeak & Seas

[57] ABSTRACT

An engine control apparatus has an intake air quantity detector which detects an intake air quantity to an engine, a controller which controls the engine in response to the output of the intake air quantity detector a load detecting detector which detects a load to the engine, and a clip device the output of the intake air quantity detecting means at a second value when a first time has passed after the load of engine has reached a predetermined value or higher.

5 Claims, 5 Drawing Sheets

CONTROL APPARATUS FOR AN ENGINE

BACKGROUND OF THE INVENTION

1Field of the Invention

The present invention relates to a control apparatus for an engine.

2. Discussion of Background

FIG. 1 is a block diagram showing the construction of a typical fuel control apparatus for an engine wherein an air flow sensor (AFS) for detecting an intake air quantity is used. In FIG. 1, a reference numeral 1 designates an air cleaner, a numeral 2 a hot wire type AFS, a numeral 3 a throttle valve for controlling the intake air quantity to the engine, a numeral 4 a surge tank, a numeral 5 an air intake manifold, a numeral 6 an air intake valve driven by a cam (not shown), and a numeral 7 a cylinder. Although FIG. 1 shows only a single cylinder for simplifying explanation, the engine is, in fact, constituted by a plurality of cylinders.

A numeral 8 designates an injector attached to each of the cylinders and a numeral 9 an electronic control unit (hereinbelow, referred to as an ECU) which controls the fuel injection quantity to the injector 8 so as to provide a predetermined air fuel ratio (A/F) with respect to air sucked into each of the cylinders. The ECU 9 determines the fuel injection quantity on the basis of the output signals of the AFS 2, a crank angle sensor 10, a start switch 11 and an engine-cooling water temperature sensor 12, and controls the pulse width of the fuel injection pulse signal to be supplied to the injector 8 in synchronism with the signal of the crank angle sensor 10. The crank angle sensor 10 may be of a well-known type of generating a rectangular waveform signal wherein it raises at the upper dead points (TDC) and falls at the lower dead points (BDC) with the revolution of the engine.

FIG. 2 is a block diagram for explaining in more detail the operation of the ECU 9.

At a revolution speed detecting section 9*a*, a revolution speed is obtained by measuring the period between adjacent TDCs of the rectangular waveform signal from the crank angle sensor 10. An averaged intake air quantity detecting section 9*b* operates to obtain the average value of output signals from the AFS 2 by the adjacent TDCs of the rectangular waveform output signal of the crank angle sensor 10. A basic pulse width subcalculation section 9*c* calculates a basic pulse width by dividing the average value of intake air quantity output signal of the average intake air quantity detecting section 9*b* by the output indicating the number of revolutions of the revolution speed detecting section 9*a*.

A warming-up correcting section 9*d* determines a correction coefficient in response to the temperature of cooling water to cool the engine, which is represented by the output of the cooling water temperature sensor 12. The basic pulse width obtained at the basic pulse width sub-calculation section 9*c* and the correction coefficient obtained at the warming-up correcting section 9*d* are added or multiplied at a correction value calculating section 9*e* to thereby obtain the pulse width for fuel injection.

On the other hand, a starting pulse sub-calculation section 9*f* calculates a starting pulse width on the basis of the detection signal of the water temperature sensor 12. A switch 9*g* selects either the injection pulse width or the starting pulse width upon receiving the output signal of the start switch 11 which detects the starting of the engine. A timer 9*h* is to effect a one-shot operation of the pulse width in time with a TDC falling point in the output signal of the crank angle sensor 10, whereby the injector 8 is actuated through an injector driving circuit 9*i*. The basic fuel injection quantity of the injector 8 corresponds to the intake air quantity per one revolution of the engine or the charging efficiency.

Generally, there takes place a pulsation of air or a reverse-flow of air in a low-speed-high-load area (1,000 -3,000 rpm and −50 mmHg-0 mmHg, in a case that no turbo charger is used) during the operation of the engine. In this case, there occurs an erroneous measurement by the AFS 2 due to the pulsation of air or the reverse flow of air.

FIG. 3 is a graph showing the relation of an air flow rate (the ordinate), boost pressure, i.e. a negative intake air pressure P (the abscissa) and a revolution speed (rpm) as parameters wherein the output of the AFS 2 (hot wire type) is sampled every 1 ms and the sampled output is converted into the flow rate wherein the value of the flow rate is averaged with respect to one air intake stroke.

As is clear from FIG. 3, the air flow rate A(n), when there occurs a reverse flow of air, shows a fairly large value in comparison with an actual air flow rate in the above-mentioned low-speed-high-load area in the engine operation. In order to eliminate such disadvantage, there has been considered that an upper limit value is determined on the extension line (indicated by a broken line) for each of the revolution speed levels at a point of a boost pressure of P=0 mmHg or a certain charging efficiency (i.e., 0.9) so that the value of intake air flow rate is clipped. Thus, by limiting the intake air flow rate A(n) to be a value which is subjected to the clipping treatment, an appropriate intake air flow rate can be obtained (when the engine is in a steady state) even in the above-mentioned low-speed-high-load area of the engine operation.

In the conventional control apparatus, however, there was found an overshoot in the air flow rate detected by the AFS 2 (as indicated by a solid line A in FIG. 4*b*) owing to an amount of air remaining in the surge tank and the intake manifold 5 when the automobile is rapidly accelerated, i.e. when the throttle valve is rapidly opened from the entirely closed state as shown by the solid line E in FIG. 4*d*. The detected air flow rate is not the value which is excessively detected due to the reverse flow of air, but is the actual flow rate. Accordingly, it is not suitable for clipping the air flow rate at the maximum air flow rate C (as indicated by one-dotted chain line) where the throttle valve is entirely opened. Namely, the conventional control apparatus wherein the upper limit is provided for each revolution speed level and the intake air quantity to the engine is clipped by the upper limit value, can not provide a good result when the engine is accelerated.

SUMMARY OF THE INVENTION

It is an object of the present invention to provide a control apparatus for an engine which eliminates the reduction of the controllability caused by an error in the intake air quantity detecting means in a high load region in the engine, and is capable of performing a correct control even in a rapid acceleration state of the engine.

The foregoing and other objects of the present invention have been attained by providing an engine control apparatus having an intake air quantity detecting means to detect an intake air quantity to an engine and a control means to control the engine in response to the output of the intake air quantity detecting means, characterized by comprising a load detecting means to detect a load to the engine, and a clip means to clip the output of the intake air quantity detecting means at a second value when a predetermined time has passed after the load of the engine has reached a first value or higher.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
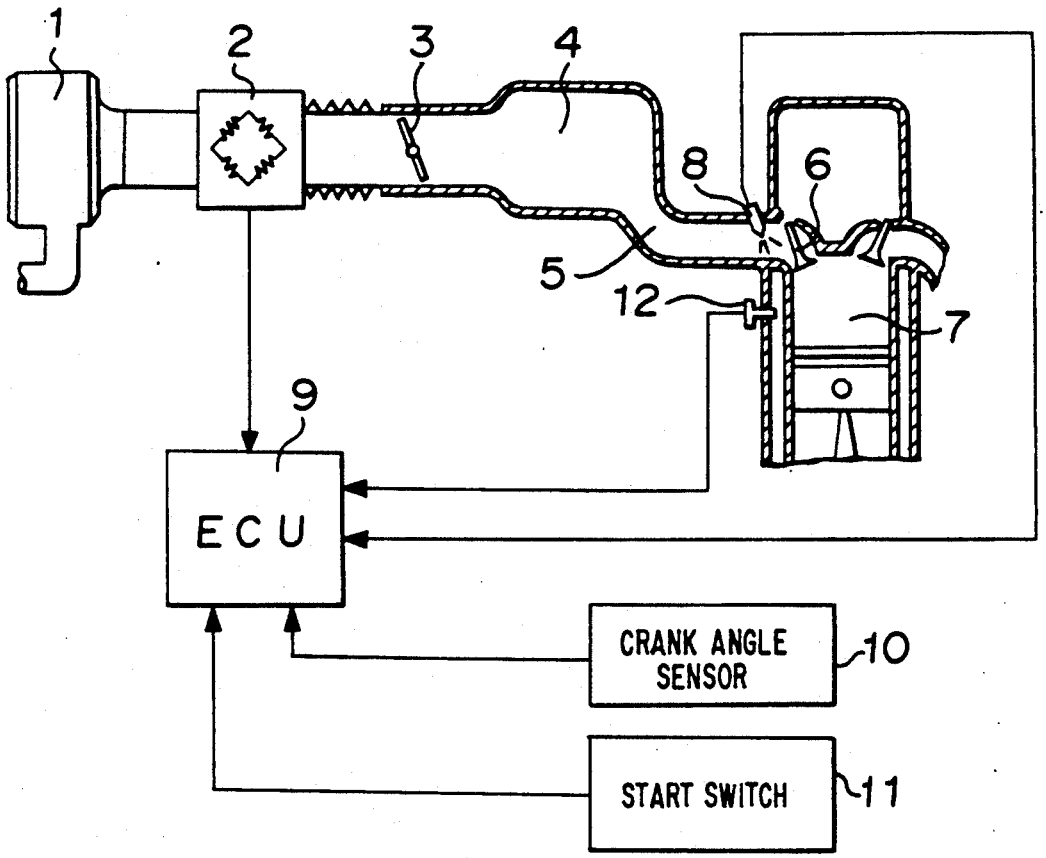
FIG. 1 is a block diagram showing the construction of a typical control apparatus for an engine.
Figure 2:
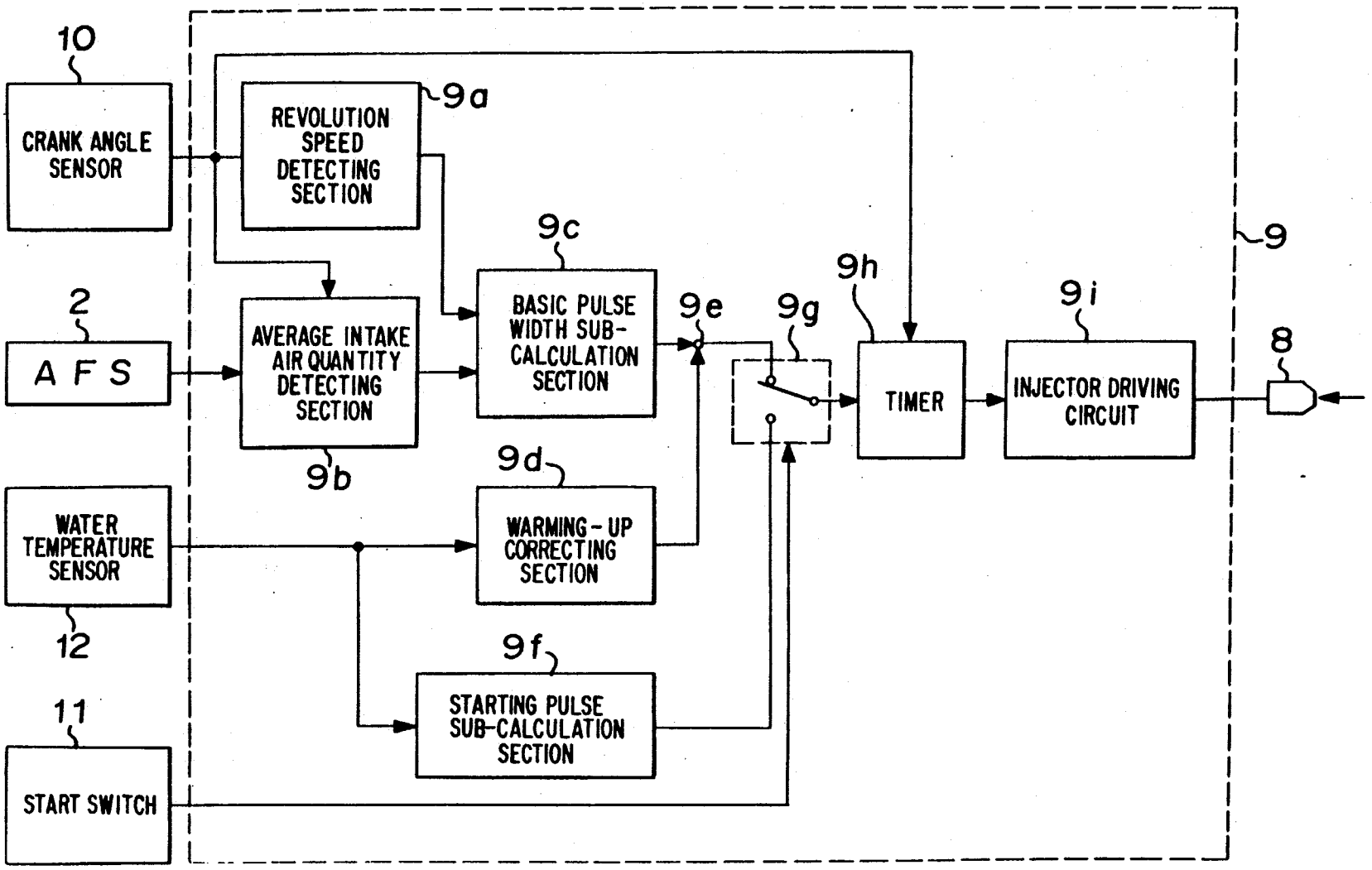
FIG. 2 is a block diagram showing the construction of a typical ECU used for the control apparatus.
Figure 3:
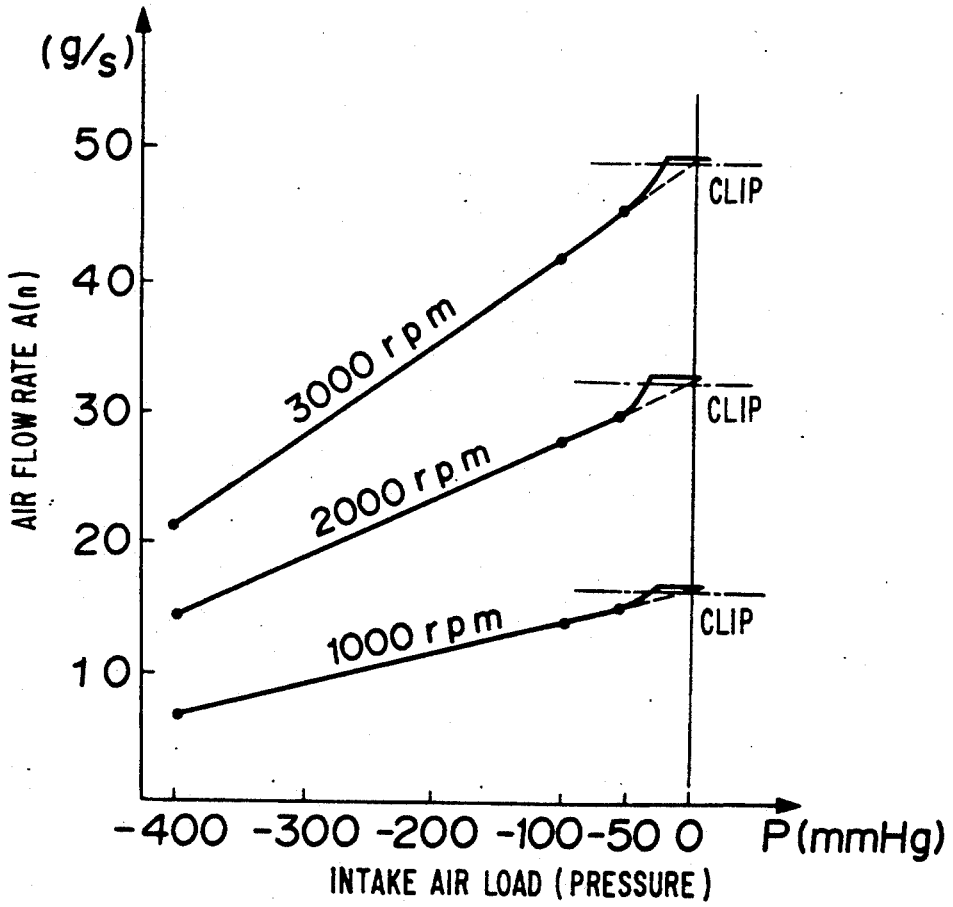
FIG. 3 is the output characteristic diagram of the AFS used for a typical control apparatus.

A preferred embodiment of the control apparatus for an engine will be described with reference to the drawings. The construction of the control apparatus of the present invention is the same as those shown in FIGS. 1 and 2. Accordingly, the same reference numerals designate the same or corresponding parts.

The operation of the control apparatus will be described with reference to the flow chart shown in FIG. 5.

At step 101, an average air quantity A(n) between adjacent TDCs is obtained by dividing an accumulated air quantity S which is obtained in a constant time interruption routine (not shown in the drawings) by the number of accumulations i, and then, the memory in a RAM which keeps the values S and i in the ECU is reset.

At step 102, a determination is made whether or not there is a high load state, i.e. the load is at a predetermined value or higher, by using a load parameter such as a throttle opening degree, a boost pressure or another. When it is found that there is a low load, a predetermined value is set at a clip control counter Cmax at step 103. On the other hand, when a high load is found, determination is made at step 104 whether or not the value of the clip control counter Cmax is 0. When the determination is negative, counting down is conducted in the clip control counter Cmax at step 105.

On the other hand, when it is found that the value of the clip control counter Cmax is 0, the maximum value Amax of intake air quantity is read at step 106. The maximum value Amax may be determined by using the revolution speed as a parameter and the maximum value is stored in a ROM in the ECU 9.

At step 107, determination is made as to whether or not the average air quantity A(n) between the TDCs exceeds the maximum value Amax. When the determination is affirmative, the value A(n) is set as Amax at step 108, whereby the clipping operation is effected.

Figure 4:
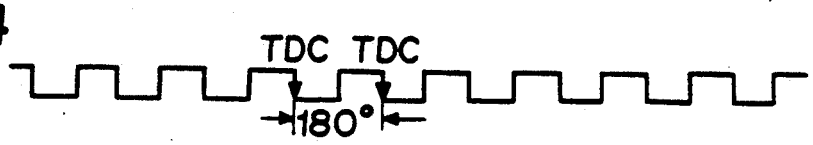
FIG. 4 is a time chart showing the operation of the control apparatus according to the present invention.
Figure 4:
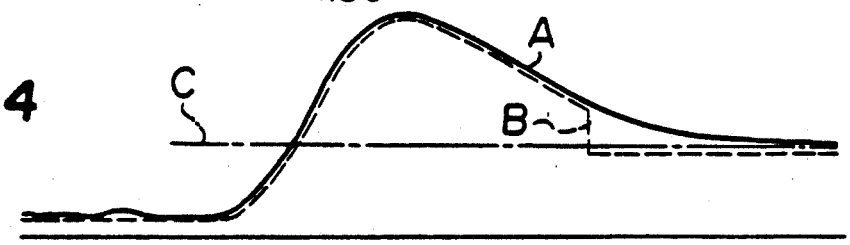
Figure 4:
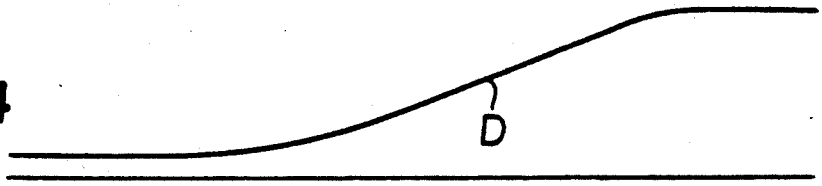
Figure 4:
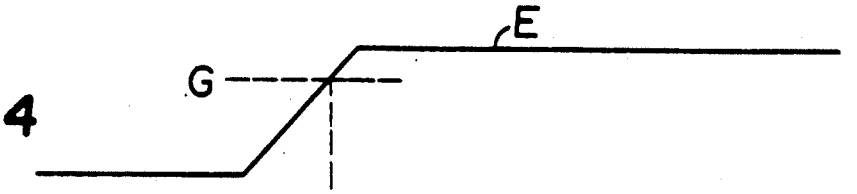
Figure 4:
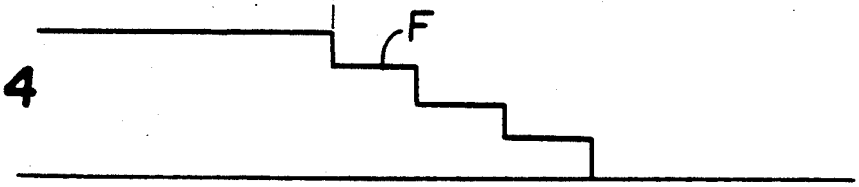

FIG. 4 is a time chart showing the waveforms of the major components of the engine in a case that the intake air quantity exceeds the maximum value at the time of rapid acceleration of the engine. FIG. 4*a* is the waveform of the crank angle signal. In FIG. 4*d*, the solid line E indicates a case that the throttle opening degree is suddenly made large. FIG. 4*c* shows that the negative pressure D in the surge tank 4 increases with an amount of air charged in the surge tank. At this moment, there takes place an overshoot in an air flow rate A detected by the AFS 2. The waveform of the overshoot corresponds to that of the actual amount of intake air. The judgement as to how much amount of load is applied to the engine depends on the throttle opening degree E, and when a value of the load exceeds the level G at which the judgement of high load is made, the counting-down of the count value F is effected each time of ignition at the clip control counter Cmax. During the counting operation, the intake air quantity detected by the AFS 2 is continuously used as the intake air quantity. When the count value F becomes 0, determination is made as to whether or not the detected air flow rate A exceeds the maximum value C (i.e. Amax). When the detected air flow rate exceeds the maximum value C, the detected air flow rate is clipped at the maximum value C.

When a low load is applied to the engine, or the air flow rate A is lower than the maximum value C even when the value counted by the counter is 0, the detected air flow rate A is used. Accordingly, air flow rate indicated by the dotted line B in FIG. 4*b* is obtainable, and the fuel injection corresponding to the air flow rate can be attained: In the conventional control apparatus, on the other hand, the air flow rate is clipped immediately after the air flow rate exceeds maximum value C, whereby the fuel injection quantity does not correspond to the intake air quantity.

In the above-mentioned embodiment, the judgement as to the high load is made depending on the throttle opening degree of the throttle valve. However, the judgement may be determined by using a negative pressure or a charging efficiency. Further, the counting-down at the counter may be conducted each time of ignition. Further, the counting-down may be effected at constant time intervals.

Figure 5:
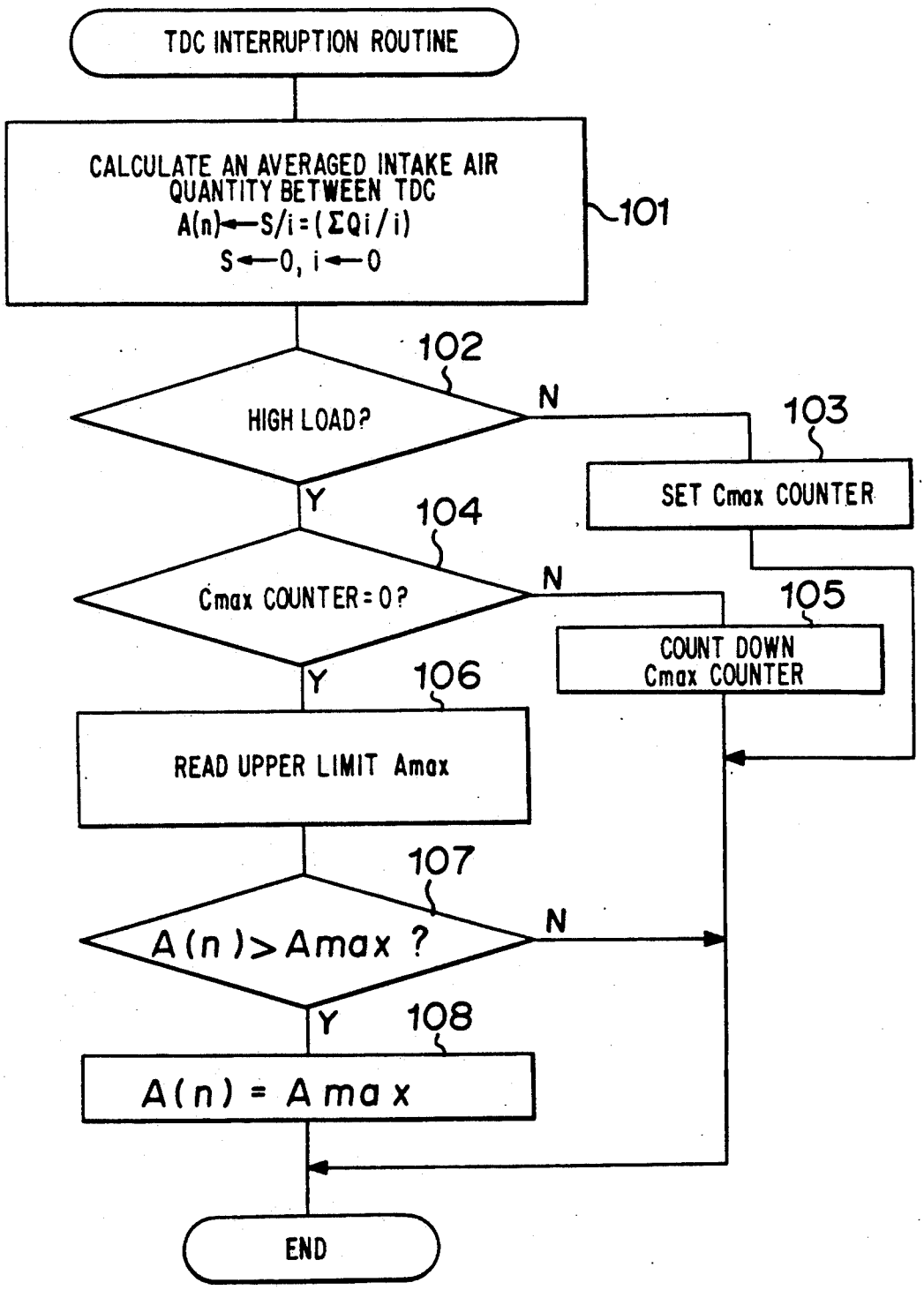
FIG. 5 is a flow chart showing the operation of the control apparatus according to the present invention.

In FIG. 5, description is made as to use of the average value of the output of the AFS 2 between the TDCs. On the other hand, in FIG. 4, description is made as to use of the output of the AFS 2 directly. Thus, the effect of the present invention can be obtained by either of the cases.

Obviously, numerous modifications and variations of the present invention are possible in light of the above teachings. It is therefore to be understood that within the scope of the appended claims, the invention may be practiced otherwise than as specifically described herein.

What is claimed is:

1. An engine control apparatus, comprising:

intake air quantity detecting means for detecting an intake quantity of an engine;

control means for controlling the engine in response to the output of the intake air quantity detecting means;

load detecting means for detecting a load on the engine; and clipping means for clipping the output of the intake air quantity detecting means at a second value when a predetermined time has passed after the load of said engine has reached a first value or higher, wherein the output of said intake air quantity detecting means is continuously supplied to said control means during said predetermined time after the load of said engine has reached said first value or higher and before said output of said intake air quantity detecting means is clipped.

2. The engine control apparatus according to claim 1, further comprising an air flow sensor, wherein the intake air quantity is obtained by averaging output values of said air flow sensor sampled with respect to a crank angle pulse signal.

3. The engine control apparatus according to claim 1, further comprising a throttle value, wherein the load on the engine is determined depending on a throttle opening degree of the throttle valve.

4. An engine control apparatus, comprising:

intake air quantity detecting means for detecting an intake quantity of an engine;

control means for controlling the engine in response to the output of the intake air quantity detecting means;

load detecting means for detecting a load on the engine;

clipping means for clipping the output of the intake air quantity detecting means at a second value when a predetermined time has passed after the load of said engine has reached a first value or higher, said first value being greater than said second value, and said first value or higher representing said engine operating under a high load and said second value representing said engine operating under a relatively low load state, wherein said load detecting means detects and determines a load on said engine based on an output of said load detecting means being a predetermined value or higher; and means for setting an indicator when said engine is in said high load state, said clipping means operating according to a presence or absence of said indicator.

5. The engine control apparatus according to claim 4, wherein the output of said intake air quantity detecting means is continuously supplied to said control means during said predetermined time after the load of said engine has reached said first value or higher and before said output of said intake air quantity detecting means is clipped.

* * * * *